US009828932B2

(12) United States Patent
Santoso et al.

(10) Patent No.: US 9,828,932 B2
(45) Date of Patent: Nov. 28, 2017

(54) SYSTEM AND METHOD FOR CONTROLLING A COOLING SYSTEM OF AN ENGINE EQUIPPED WITH A START-STOP SYSTEM

(71) Applicant: GM GLOBAL TECHNOLOGY OPERATIONS LLC, Detroit, MI (US)

(72) Inventors: Halim G. Santoso, Novi, MI (US); Eugene V. Gonze, Pinckney, MI (US); James R. Yurgil, Livonia, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 625 days.

(21) Appl. No.: 13/789,767

(22) Filed: Mar. 8, 2013

(65) Prior Publication Data

US 2014/0257676 A1 Sep. 11, 2014

(51) Int. Cl.

| | |
|---|---|
| ***F02D 45/00*** | (2006.01) |
| ***F02D 35/02*** | (2006.01) |
| ***F02D 41/06*** | (2006.01) |
| ***F01B 3/06*** | (2006.01) |
| *F02N 11/08* | (2006.01) |

(52) U.S. Cl.

CPC ..... *F02D 45/00* (2013.01); *F01B 3/06* (2013.01); *F02D 35/025* (2013.01); *F02D 35/026* (2013.01); *F02D 41/065* (2013.01); *F02N 11/0814* (2013.01)

(58) Field of Classification Search

CPC .. F02N 11/0814; F02D 41/065; F02D 35/025; F02D 35/026

USPC ..... 701/112; 73/114.28

See application file for complete search history.

(56) References Cited

U.S. PATENT DOCUMENTS

| | | | | |
|---|---|---|---|---|
| 4,489,680 | A * | 12/1984 | Spokas | F01P 7/048 123/41.05 |
| 4,563,994 | A * | 1/1986 | Ujihashi | F02D 41/345 123/480 |
| 5,115,778 | A * | 5/1992 | Holroyd | 123/406.2 |
| 5,783,744 | A * | 7/1998 | Chun | G01L 23/225 123/406.37 |
| 2004/0216714 | A1* | 11/2004 | Tayama | F02B 23/101 123/276 |
| 2006/0157010 | A1* | 7/2006 | Moriwaki | F01L 9/02 123/90.13 |
| 2008/0154484 | A1* | 6/2008 | Takeyama | F02D 41/065 701/113 |
| 2009/0043478 | A1* | 2/2009 | Labonte | F02D 35/027 701/103 |

(Continued)

FOREIGN PATENT DOCUMENTS

| | | | |
|---|---|---|---|
| EP | 2045452 | A1 * | 4/2009 |
| FR | 2942270 | A1 * | 8/2010 |
| WO | WO 2013008296 | A1 * | 1/2013 |

*Primary Examiner* — Mahmoud Gimie
*Assistant Examiner* — Josh Campbell

(57) ABSTRACT

A system according to the principles of the present disclosure includes a start-stop module, a pre-ignition risk module, and a cooling control module. The start-stop module stops and restarts an engine independent from an input received from an ignition system. The pre-ignition risk module monitors a risk of pre-ignition when the engine is restarted and generates a signal based on the risk of pre-ignition. The cooling control module controls a cooling system to circulate coolant through the engine when the engine is stopped in response to the risk of pre-ignition.

24 Claims, 4 Drawing Sheets

(56) References Cited

U.S. PATENT DOCUMENTS

| | | | | |
|---|---|---|---|---|
| 2010/0012086 | A1* | 1/2010 | Demura | F02D 13/0219<br>123/399 |
| 2011/0106410 | A1* | 5/2011 | Yoshino | F02D 13/0226<br>701/103 |
| 2011/0197845 | A1* | 8/2011 | Flowers | F02F 3/003<br>123/193.6 |
| 2011/0232276 | A1* | 9/2011 | Yaguchi | F02G 1/043<br>60/517 |
| 2014/0088852 | A1* | 3/2014 | Yaguchi | F02D 35/023<br>701/103 |

* cited by examiner

SYSTEM AND METHOD FOR CONTROLLING A COOLING SYSTEM OF AN ENGINE EQUIPPED WITH A START-STOP SYSTEM

FIELD

The present disclosure relates to internal combustion engines, and more specifically, to systems and methods for controlling a cooling system of an engine equipped with a start-stop system.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Engine water pumps are typically belt-driven centrifugal pumps that circulate coolant through an engine to cool the engine. Coolant is received through an inlet located near the center of a pump, and an impeller in the pump forces the coolant to the outside of the pump. Coolant is received from a radiator, and coolant exiting the pump flows through an engine block and a cylinder head before returning to the radiator.

In a conventional water pump, the impeller is always engaged with a belt-driven pulley. Thus, the pump circulates coolant through the engine whenever the engine is running. In contrast, an electric water pump is not driven by an engine. Thus, an electric water pump may be switched on or off regardless of whether the engine is running. The electric water pump may be switched off to improve fuel economy, and the electric water pump may be switched on to cool the engine.

SUMMARY

A system according to the principles of the present disclosure includes a start-stop module, a pre-ignition risk module, and a cooling control module. The start-stop module stops and restarts an engine independent from an input received from an ignition system. The pre-ignition risk module monitors a risk of pre-ignition when the engine is restarted and generates a signal based on the risk of pre-ignition. The cooling control module controls a cooling system to circulate coolant through the engine when the engine is stopped in response to the risk of pre-ignition.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

A start-stop system automatically stops and restarts an engine when the engine is idling to reduce the amount of time that the engine idles and thereby reduce fuel consumption and emissions of the engine. An engine equipped with a start-stop system may be cooled by a cooling system that includes an electric water pump. A control system may switch the water pump off when the engine is stopped to improve fuel economy. The control system may switch the water pump on when the engine is restarted to maintain an engine coolant temperature at a desired temperature.

The control system may increase the desired temperature at which the engine coolant temperature is maintained in order to improve fuel economy of the engine. Increasing the desired temperature decreases the viscosity of oil in the engine, which decreases friction between components of the engine. In addition, increasing the desired temperature reduces the amount of heat loss from combustion chamber(s) of the engine to coolant in the engine, which improves the efficiency of the engine. However, increasing the desired temperature may cause pre-ignition in the engine when the engine is restarted after the engine is stopped since the temperature of air within cylinders of the engine increases while the engine is stopped. Therefore, the risk of pre-ignition may limit the increase in the desired temperature and the associated improvements in fuel economy.

A system and method according to the present disclosure controls a cooling system to circulate coolant through a radiator and an engine when the engine is stopped to reduce the risk of pre-ignition when the engine is restarted. The system and method monitors certain engine operating conditions and circulates coolant through the engine when the engine operating conditions indicate that a risk of pre-ignition is greater than a threshold. In turn, the engine may be operated at a higher coolant temperature without increasing the risk of pre-ignition when the engine is restarted. In one example, the system and method switches an electric water pump on to circulate coolant through the radiator and the engine when the engine is stopped.

Figure 1:
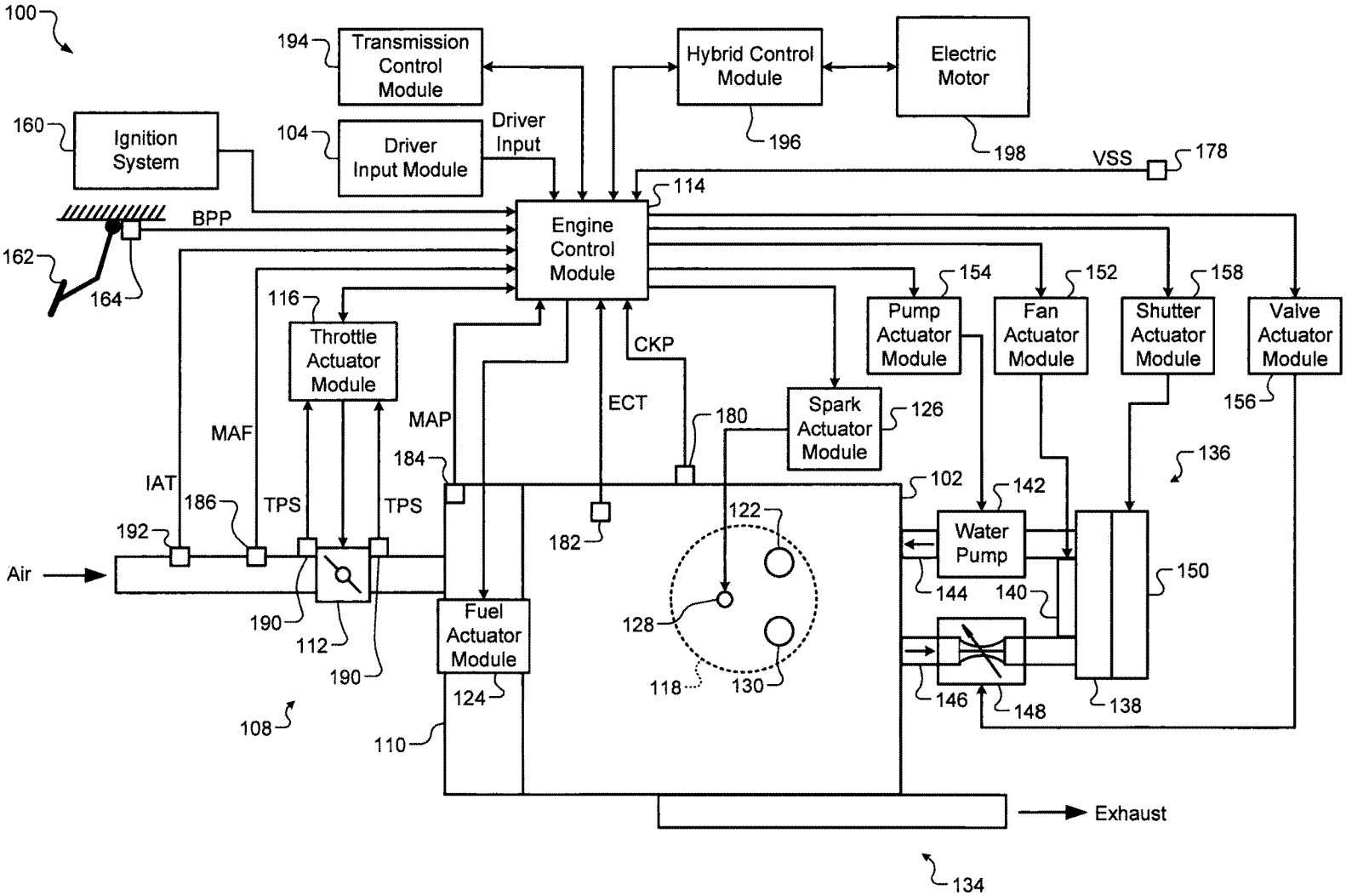
FIG. 1 is a functional block diagram of an example engine system according to the principles of the present disclosure.

Referring to FIG. 1, an example implementation of an engine system 100 includes an engine 102. The engine 102 combusts an air/fuel mixture to produce drive torque for a vehicle based on driver input from a driver input module 104. Air is drawn into the engine 102 through an intake system 108. The intake system 108 includes an intake manifold 110 and a throttle valve 112. In one example, the throttle valve 112 includes a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations, fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 114. In turn, the spark plug 128 generates a spark that ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. The spark actuator module 126 may have the ability to vary the timing of the spark for each firing event. The spark actuator module 126 may even be capable of varying the spark timing for a next firing event when the spark timing signal is changed between a last firing event and the next firing event. In various implementations, the engine 102 may include multiple cylinders and the spark actuator module 126 may vary the spark timing relative to TDC by the same amount for all cylinders in the engine 102.

During the combustion stroke, the combustion of the air/fuel mixture drives the piston down, thereby driving the crankshaft. The combustion stroke may be defined as the time between the piston reaching TDC and the time at which the piston returns to bottom dead center (BDC). During the exhaust stroke, the piston begins moving up from BDC and expels the byproducts of combustion through an exhaust valve 130. The byproducts of combustion are exhausted from the vehicle via an exhaust system 134.

A cooling system 136 for the engine 102 includes a radiator 138, a cooling fan 140, a water pump 142, an inlet hose 144, an outlet house 146, a control valve 148, and shutters 150. Coolant flows from the radiator 138 to the engine 102 through the inlet hose 144. Coolant flows from the engine 102 to the radiator 138 through the outlet hose 146. As the vehicle moves, air flows through the radiator 138 and cools coolant flowing through the radiator 138. In addition, the cooling fan 140 blows air through the radiator 138 when the cooling fan 140 is switched on. The cooling fan 140 may be an electric fan that operates independent from the engine 102. A fan actuator module 152 switches the cooling fan 140 on or off based on instructions received from the ECM 114.

The water pump 142 circulates coolant through the engine 102 and the radiator 138 when the water pump 142 is switched on. The water pump 142 may be an electric water pump that operates independent from the engine 102. A pump actuator module 154 switches the water pump 142 on or off based on instructions received from the ECM 114. The control valve 148 allows coolant flow through the outlet hose 146 when the control valve 148 is open and prevents coolant flow through the outlet hose 146 when the control valve 148 is closed. A valve actuator module 156 opens and closes the control valve 148 based on instructions received from the ECM 114.

The shutters 150 allow airflow through the radiator 138 when the shutters 150 are open and prevent airflow through the radiator 138 when the shutters 150 are closed. A shutter actuator module 158 opens and closes the shutters 150 based on instructions received from the ECM 114. The ECM 114 may close the shutters 150 to decrease the aerodynamic drag of the vehicle and thereby improve fuel economy. The ECM 114 may open the shutters 150 to cool coolant flowing through the radiator 138 and thereby cool the engine 102.

The ECM 114 may start the engine 102 and stop the engine 102 based on input received from an ignition system 160. The ignition system 160 may include a key or a button. The ECM 114 may start the engine 102 when a driver turns the key from an off position to an on position or when the driver presses the button. The ECM 114 may stop the engine 102 when a driver turns the key from the on position to the off position or when the driver presses the button while the engine 102 is running.

A driver may depress a brake pedal 162 to decelerate and/or stop the vehicle. The engine system 100 may measure the position of the brake pedal 162 using a brake pedal position (BPP) sensor 164. The ECM 114 may determine when the brake pedal 162 is depressed or released based on input received from the BPP sensor 164 and/or based on input received from a brake line pressure sensor (not shown).

The engine system 100 may measure the speed of the vehicle using a vehicle speed sensor (VSS) 178. The engine system 100 may measure the position of the crankshaft using a crankshaft position (CKP) sensor 180. The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The ECM 114 may use signals from the sensors to make control decisions for the engine system 100.

The ECM 114 may communicate with a transmission control module 194 to coordinate shifting gears in a transmission (not shown). For example, the ECM 114 may reduce engine torque during a gear shift. The ECM 114 may communicate with a hybrid control module 196 to coordinate operation of the engine 102 and an electric motor 198. The electric motor 198 may function as a generator, and may be used to produce electrical energy for use by vehicle electrical systems and/or for storage in a battery. In various implementations, the ECM 114, the transmission control module 194, and the hybrid control module 196 may be integrated into one or more modules.

Figure 2:
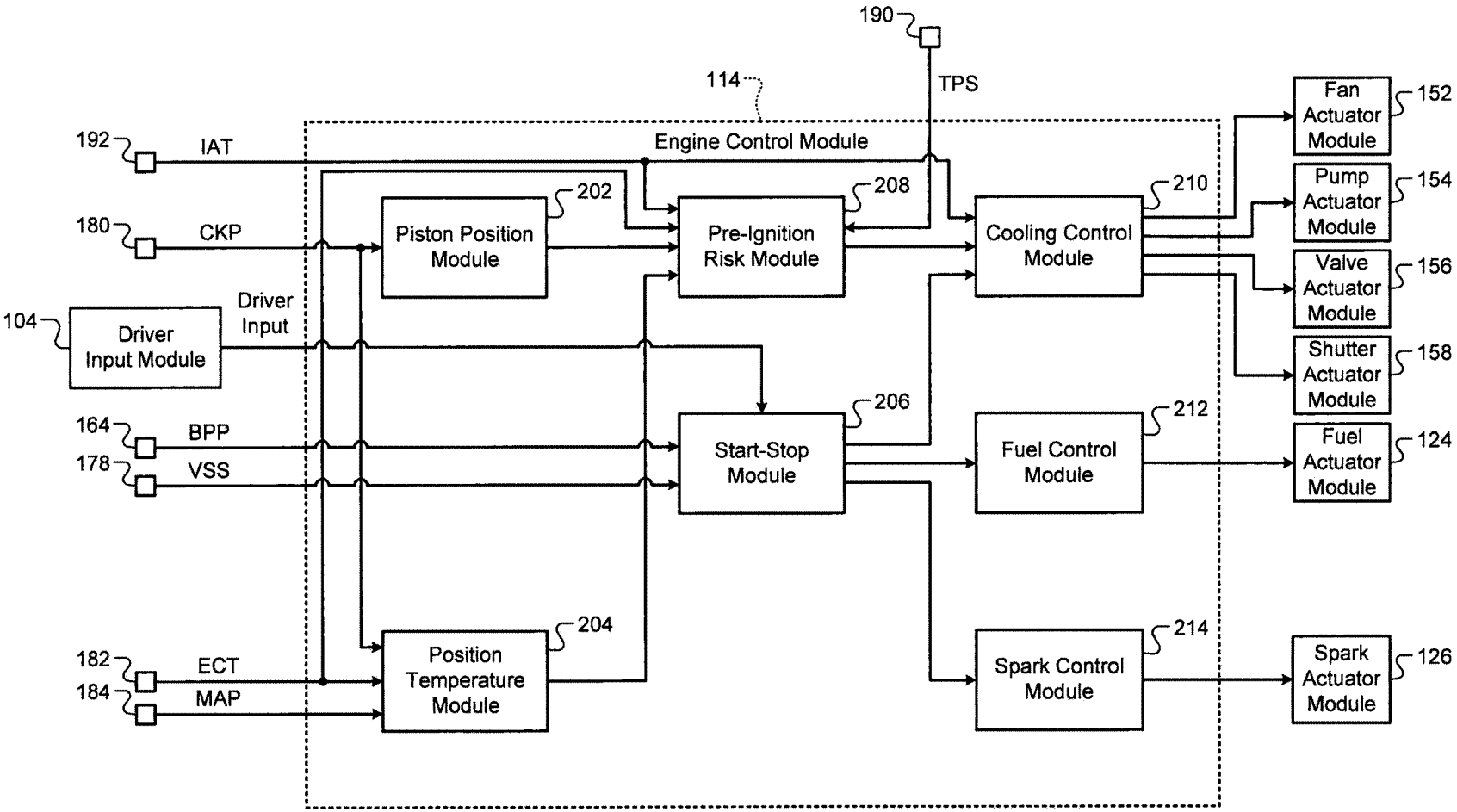
FIG. 2 is a functional block diagram of an example control system according to the principles of the present disclosure.

Referring to FIG. 2, the ECM 114 may include a piston position module 202, a piston temperature module 204, a start-stop module 206, a pre-ignition risk module 208, a cooling control module 210, a fuel control module 212, and a spark control module 214. The piston position module 202 determines a position of the piston within the cylinder 118. The piston position module 202 may determine the piston position based on the crankshaft position from the CKP sensor 180. For example, the piston position module 202 may determine the piston position based on a predetermined relationship between the crankshaft position and the piston position. The piston position module 202 outputs the piston position. The piston position module 202 may specify the piston position in terms of an amount of crankshaft rotation before TDC is achieved.

The piston temperature module 204 estimates a temperature of the piston within the cylinder 118. The piston temperature module 204 may estimate the piston temperature based on engine operating conditions such as the engine coolant temperature from the ECT sensor 182, the engine speed, engine load, and/or an engine operating period. The piston temperature module 204 outputs the piston temperature.

The piston temperature module 204 may determine the engine speed based on the crankshaft position from the CKP sensor 180. The piston temperature module 204 may determine engine speed based on an amount of crankshaft rotation between tooth detections and the corresponding period. The piston temperature module 204 may determine the engine load based on the manifold pressure from the MAP sensor 184. In various implementations, the ECM 114 may include an engine speed module and an engine load module that determine the engine speed and the engine load, respectively, in the manner described above.

The start-stop module 206 automatically stops and restarts the engine 102 when the engine 102 is idling. The start-stop module 206 may automatically stop the engine 102 when the vehicle speed is less than or equal to a predetermined speed (e.g., zero) and the driver depresses the brake pedal 162. The start-stop module 206 may automatically restart the engine 102 when the driver releases the brake pedal 162 and/or when the driver depresses an accelerator pedal (not shown). The start-stop module 206 may receive the vehicle speed from the VSS sensor 178. The start-stop module 206 may determine when the driver depresses or releases the brake pedal 162 based on input received from the BPP sensor 164.

The start-stop module 206 may automatically stop and restart the engine 102 by sending signals to the fuel control module 212 and/or the spark control module 214. The fuel control module 212 may stop or start the engine 102 by instructing the fuel actuator module 124 to stop or start providing fuel to the cylinder 118. The spark control module 214 may stop or start the engine 102 by instructing the spark actuator module 126 to stop or start providing spark to the cylinder 118.

When the engine 102 is stopped, the pre-ignition risk module 208 monitors a risk of pre-ignition when the engine is restarted. The pre-ignition risk module 208 may determine the risk of pre-ignition based on one or more engine operating conditions. The engine operating conditions may include the intake air temperature from the IAT sensor 192, the piston position, and/or the piston temperature. The engine operating conditions may also include the throttle position before engine shutdown. The pre-ignition risk module 208 may receive the throttle position from the TPS sensor 190. The pre-ignition risk module 208 outputs the risk of pre-ignition.

The cooling control module 210 may determine whether the risk of pre-ignition is greater than a threshold and circulate coolant through the engine 102 and the radiator 138 when the risk of pre-ignition is greater than the threshold. For example, the cooling control module 210 may instruct the pump actuator module 154 to switch the water pump 142 on and instruct the valve actuator module 156 to open the control valve 148 when the risk of pre-ignition is greater than the threshold. In addition, the water pump 142 may be a variable capacity pump, and the cooling control module 210 may instruct the pump actuator module 154 to operate the water pump 142 at full capacity when the risk of pre-ignition is greater than the threshold.

The cooling control module 210 may also facilitate airflow through the radiator 138 when the risk of pre-ignition is greater than the threshold. For example, the cooling control module 210 may instruct the fan actuator module 152 to switch the cooling fan 140 on and/or instruct the shutter actuator module 158 to open the shutters 150 when the risk of pre-ignition is greater than the threshold. The threshold may be a predetermined percentage.

The cooling control module 210 may determine that the risk of pre-ignition is greater than the threshold when the intake air temperature is greater than a first temperature (e.g., 10 degrees Celsius (° C.)). The cooling control module 210 may determine that the risk of pre-ignition is greater than the threshold when the piston temperature is greater than a second temperature (e.g., 100° C.). The cooling control module 210 may determine that the risk of pre-ignition is greater than the threshold when the piston position corresponds to an amount of crankshaft rotation before TDC that is greater than a first amount (e.g., from 60 degrees to 100 degrees).

The cooling control module 210 may determine that the risk of pre-ignition is greater than the threshold when the engine coolant temperature is greater than a third temperature. The third temperature may be predetermined or determined based on a predetermined relationship between the engine coolant temperature, one or more other engine operating conditions, and the risk of pre-ignition. The predetermined relationship may be embodied in a lookup table and/or a graph such as the graph of FIG. 4. The other engine operating conditions used to determine the third temperature may include the intake air temperature, the piston temperature, the piston position, and/or the throttle position. The first temperature, the second temperature, and/or the first amount may be predetermined or determined based on one or more engine operating conditions in a manner similar to the manner of determining the third temperature described above.

Figure 3:
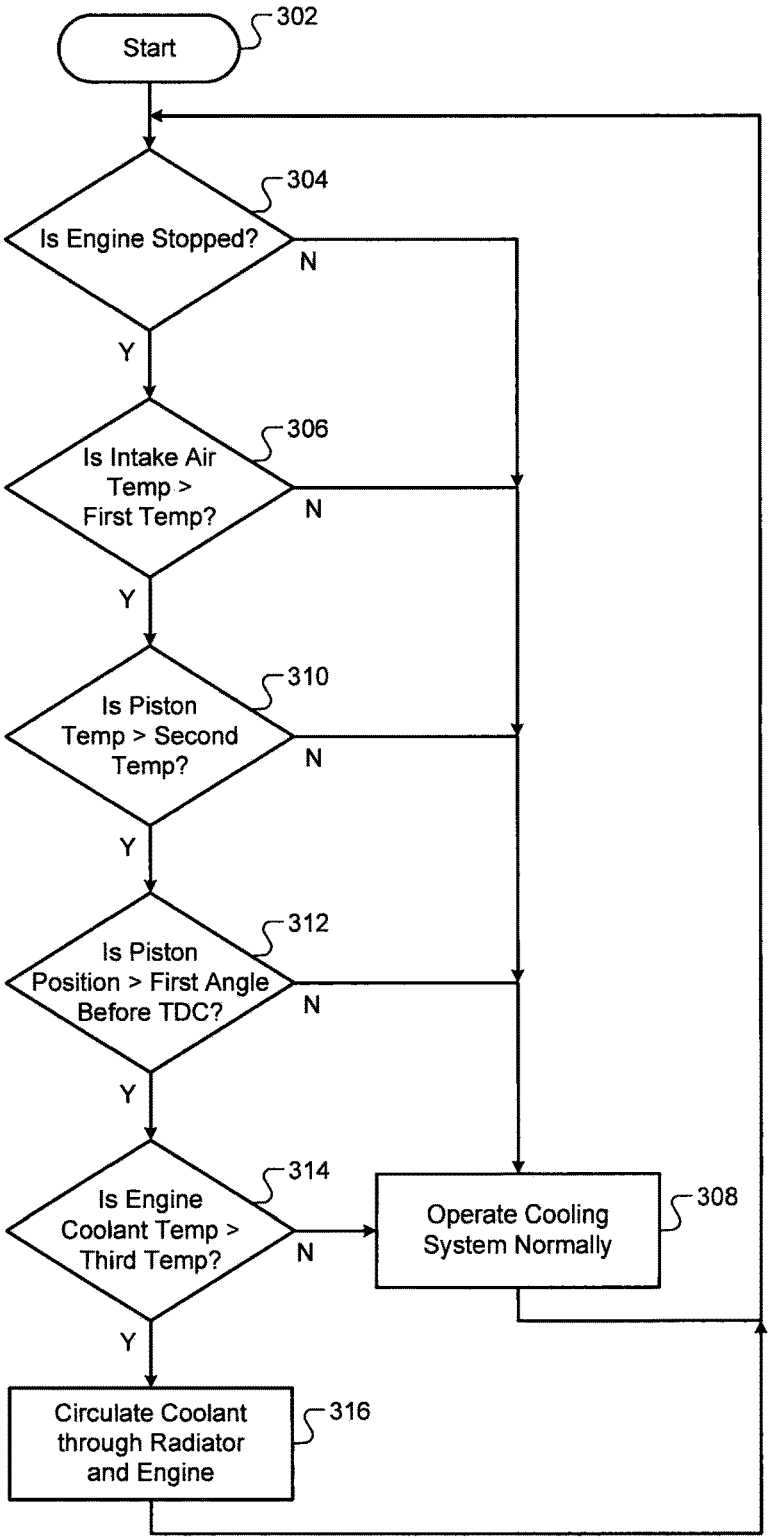
FIG. 3 is a flowchart illustrating an example control method according to the principle of the present disclosure.

Referring to FIG. 3, a method for controlling a cooling system of an engine equipped with a start-stop system begins at 302. At 304, the method determines whether the engine is stopped. If the engine is stopped, the method continues at 306. Otherwise, the method continues at 308.

At 306 through 314, the method may monitor a risk of pre-ignition when the engine is restarted and determine whether the risk of pre-ignition is greater than a threshold. For example, the method may determine that the risk of pre-ignition is greater than the threshold when the result of one or more of the determinations made at 306 through 314 is positive. If the risk of pre-ignition is greater than the threshold, the method may continue at 316. Otherwise, the method may continue at 308.

At 306, the method determines whether a temperature of intake air entering the engine is greater than a first temperature (e.g., 10° C.). If the intake air temperature is greater than the first temperature, the method continues at 310. Otherwise, the method continues at 308.

At 310, the method determines whether a temperature of a piston in the engine is greater than a second temperature (e.g., 100° C.). The method may estimate the piston temperature based on engine operating conditions such as engine coolant temperature, engine speed, engine load, and/or an engine operating period. If the piston temperature is greater than the second temperature, the method continues at 312. Otherwise, the method continues at 308.

At 312, the method determines whether a position of a piston in the engine corresponds to an amount of crankshaft rotation before TDC that is greater than a first amount (e.g., from 60 degrees to 100 degrees). If the piston position corresponds to an amount of crankshaft rotation that is greater than the first amount, the method continues at 314. Otherwise, the method continues at 308.

At 314, the method determines whether a temperature of coolant circulated through the engine is greater than a third temperature. If the engine coolant temperature is greater than the third temperature, the method continues at 316. Otherwise, the method continues at 308.

The first temperature, the second temperature, and/or the first amount, and/or the third temperature may be predetermined. Additionally or alternatively, the third temperature may be determined based on a predetermined relationship between the engine coolant temperature, one or more other engine operating conditions, and the risk of pre-ignition. The predetermined relationship may be embodied in a lookup table and/or a graph such as the graph of FIG. 4.

At 316, the method circulates coolant through a radiator and the engine when the engine is stopped. For example, the method may open a control valve to allow coolant flow between the radiator and the engine, and switch an electric water pump on to pump coolant through the radiator and the engine. In various implementations, the water pump may be a variable capacity pump, and the method may operate the water pump at full capacity when circulating coolant through the engine while the engine is off. The method may also facilitate airflow through the radiator when the engine is stopped. For example, the method may switch a cooling fan on to blow air through the radiator and/or open shutters to allow airflow through the radiator.

At 308, the method operates the cooling system normally. For example, when the engine is off, the method may close the control valve to prevent coolant flow between the radiator and the engine and switch the electric water pump off. In addition, the method may not facilitate airflow through the radiator when the engine is stopped. For example, the method may switch the cooling fan off and/or close the shutters.

Figure 4:
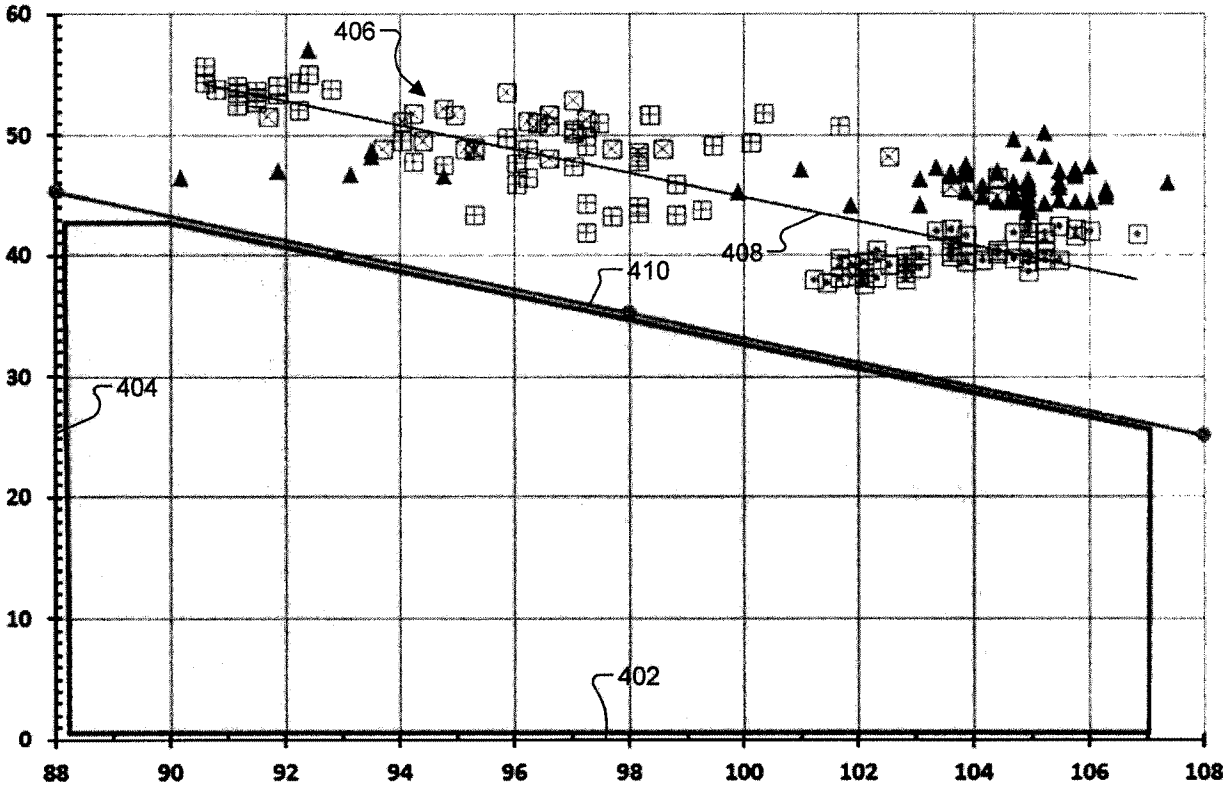
FIG. 4 is a graph illustrating an example relationship between pre-ignition and engine operating conditions according to the principle of the present disclosure.

Referring to FIG. 4, a graph illustrates a relationship between an engine coolant temperature 402, an intake air temperature 404, and pre-ignition events 406. The pre-ignition events 406 correspond to a period when an engine is automatically restarted after the engine is automatically stopped. A threshold may be predetermined by offsetting a linear regression model 408 of the pre-ignition events 406. A system and method according to the present disclosure circulates coolant through the engine and a radiator when the engine is off and the engine operating conditions 402, 404 correspond to an operating point that is above a threshold 410. The distance between the operating point and the model 408 indicates the risk of pre-ignition when the engine is restarted.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

What is claimed is:

1. A system comprising:

a start-stop module that stops and restarts an engine independent from an input received from an ignition system;

a piston temperature module that estimates a piston temperature when the engine is stopped based on a period from a first time when the engine is started to a second time when the engine is stopped; and a cooling control module that controls a cooling system to circulate coolant through the engine when the engine is stopped in response to the piston temperature being greater than a first temperature.

2. The system of claim 1 further comprising a pre-ignition risk module that, when the engine is stopped, determines a risk of pre-ignition when the engine is restarted based on the piston temperature determined when the engine is stopped.

3. The system of claim 2 wherein the pre-ignition risk module determines the risk of pre-ignition further based on a piston position when the engine is stopped.

4. The system of claim 3 wherein the cooling control module circulates coolant through the engine when the risk of pre-ignition is greater than a threshold.

5. The system of claim 2 wherein the cooling control module determines that the risk of pre-ignition is greater than the threshold when an intake air temperature is greater than a second temperature.

6. The system of claim 4 wherein the cooling control module determines that the risk of pre-ignition is greater than the threshold when the piston temperature is greater than the first temperature.

7. The system of claim 4 wherein the cooling control module determines that the risk of pre-ignition is greater than the threshold when the piston position corresponds to an amount of crankshaft rotation before top dead center that is greater than a first amount.

8. The system of claim 2 wherein the cooling control module determines that the risk of pre-ignition is greater than the threshold when an engine coolant temperature is greater than a second temperature.

9. The system of claim 8 wherein the cooling control module determines the second temperature based on a predetermined relationship between the engine coolant temperature, at least one other engine operating condition, and the risk of pre-ignition.

10. The system of claim 2 wherein the cooling system includes a water pump that pumps coolant through the engine and a radiator, a control valve that regulates coolant flow through the engine, and shutters that regulate airflow through the radiator.

11. The system of claim 10 wherein the cooling control module switches the water pump on, opens the control valve, and opens the shutters when the risk of pre-ignition is greater than the threshold.

12. The system of claim 1 wherein the piston temperature module estimates the piston temperature based on an engine coolant temperature, an engine speed, an engine load, and the period.

13. A method comprising:

stopping and restarting an engine independent from an input received from an ignition system;

estimating a piston temperature when the engine is stopped based on a period from a first time when the engine is started to a second time when the engine is stopped; and controlling a cooling system to circulate coolant through the engine when the engine is stopped in response to the piston temperature being greater than a first temperature.

14. The method of claim 13 further comprising, when the engine is stopped, determining a risk of pre-ignition when the engine is restarted based on the piston temperature determined when the engine is stopped.

15. The method of claim 14 further comprising determining the risk of pre-ignition further based on a piston position when the engine is stopped.

16. The method of claim 15 further comprising circulating coolant through the engine when the risk of pre-ignition is greater than a threshold.

17. The method of claim 16 further comprising determining that the risk of pre-ignition is greater than the threshold when an intake air temperature is greater than a second temperature.

18. The method of claim 16 further comprising determining that the risk of pre-ignition is greater than the threshold when the piston temperature is greater than the first temperature.

19. The method of claim 16 further comprising determining that the risk of pre-ignition is greater than the threshold when the piston position corresponds to an amount of crankshaft rotation before top dead center that is greater than a first amount.

20. The method of claim 16 further comprising determining that the risk of pre-ignition is greater than the threshold when an engine coolant temperature is greater than a second temperature.

21. The method of claim 20 further comprising determining the second temperature based on a predetermined relationship between the engine coolant temperature, at least one other engine operating condition, and the risk of pre-ignition.

22. The method of claim 16 wherein the cooling system includes a water pump that pumps coolant through the engine and a radiator, a control valve that regulates coolant flow through the engine, and shutters that regulate airflow through the radiator.

23. The method of claim 22 further comprising switching the water pump on, opening the control valve, and opening the shutters when the risk of pre-ignition is greater than the threshold.

24. The method of claim 13 further comprising estimating the piston temperature based on an engine coolant temperature, an engine speed, an engine load, and the period.

* * * * *